US005366143A

United States Patent [19]

Vollers

[11] Patent Number: 5,366,143

[45] Date of Patent: Nov. 22, 1994

[54] PRODUCE BOX WITH CELLULAR PLASTIC WALLS

[76] Inventor: Gary L. Vollers, 11471 Tampa Ave., #149, Northridge, Calif. 91326

[21] Appl. No.: 153,527

[22] Filed: Nov. 22, 1993

Related U.S. Application Data

[63] Continuation-in-part of Ser. No. 130,872, Oct. 4, 1993.

[51] Int. Cl.[5] ..... B65D 5/32; B65D 5/42

[52] U.S. Cl. ..... 229/199; 229/23 R; 229/916; 229/919

[58] Field of Search ..... 206/503; 220/6, 7; 229/23 R, 199, 915, 916, 919; 217/36, 52

[56] References Cited

U.S. PATENT DOCUMENTS

| | | | |
|---|---|---|---|
| 1,699,130 | 1/1929 | Anderson | 217/36 |
| 2,072,672 | 3/1937 | Frost | 229/916 |
| 2,414,659 | 1/1947 | Montague | 229/916 |
| 2,551,814 | 5/1951 | Rushing et al. . | |
| 2,633,285 | 3/1953 | Kells . | |
| 2,736,487 | 2/1956 | George . | |
| 3,010,638 | 11/1961 | Forrer . | |
| 3,373,921 | 3/1968 | Crane | 229/23 R |
| 3,623,650 | 11/1971 | Watts . | |
| 3,632,037 | 1/1972 | Webb et al. | 229/23 R |
| 3,713,579 | 1/1973 | Chaffers . | |
| 3,905,478 | 9/1975 | Petersen et al. | 217/52 |
| 3,905,541 | 9/1975 | Paxton | 229/23 R |
| 3,921,896 | 11/1975 | Ishimura . | |
| 4,187,977 | 2/1980 | Boykin et al. . | |
| 4,230,233 | 10/1980 | Orr | 229/23 R |
| 4,245,773 | 1/1981 | Stollberg . | |
| 4,251,006 | 2/1981 | Smith | 217/36 |
| 4,277,015 | 7/1981 | Crane . | |
| 4,291,830 | 9/1981 | Sorensen . | |
| 4,389,013 | 6/1983 | Hall et al. . | |
| 4,482,074 | 11/1984 | Calley | 220/6 |
| 4,685,610 | 8/1987 | Carter et al. | 229/916 |
| 4,762,270 | 8/1988 | Stoll et al. | 229/939 |
| 4,763,833 | 8/1988 | Stoll | 229/939 |
| 4,828,894 | 5/1989 | Taylor | 229/23 R |
| 4,911,356 | 3/1990 | Townsend et al. | 229/919 |
| 4,948,039 | 8/1990 | Anatangelo | 220/418 |
| 4,993,623 | 2/1991 | Kelly et al. | 229/23 R |
| 5,038,998 | 8/1991 | Morris et al. | 229/23 R |
| 5,116,290 | 5/1992 | Ross | 229/23 R |
| 5,190,213 | 3/1993 | Horwitz | 229/939 |

FOREIGN PATENT DOCUMENTS

| | | | |
|---|---|---|---|
| 2449605 | 9/1980 | France | 229/919 |

OTHER PUBLICATIONS

The Wiley Encyclopedia of Packaging Technology, John Wiley & Sons, pp. 341–346 (1986).

*Primary Examiner*—Gary E. Elkins
*Attorney, Agent, or Firm*—William W. Haefliger

[57] ABSTRACT

A box structure comprising box side walls, bottom wall, and two end walls. The two end walls each have substantially greater thickness than the side walls, and the bottom wall. The end walls have peripheral edges; the bottom wall and side walls have edge portions overlapping certain peripheral edges of the end walls. There is attachment structure attaching the bottom wall and the side wall edge portions to the end wall peripheral edges. The end walls consist essentially of lightweight, cellular, synthetic resin. The side walls and the bottom wall are defined by thin, inner and outer sheets and webs interconnecting the sheets. The webs are elongated, whereby parallel, lengthwise, elongated cells are formed by the inner and outer sheets and webs; the inner and outer sheets consist of synthetic resin, and the cells have length direction. The bottom wall and the side wall form a continuous strip, which is folded to fit against certain peripheral edges of the end walls; certain peripheral edges are flat. The webs extend at slant angles between the sheets, whereby the elongated cells have parallelogram configuration in planes normal to the length direction of the elongated cells. The elongated cells between the webs extend generally toward the end walls.

16 Claims, 3 Drawing Sheets

PRODUCE BOX WITH CELLULAR PLASTIC WALLS

This application is a continuation-in-part of Ser. No. 08/130,872 filed Oct. 4, 1993 pending.

BACKGROUND OF THE INVENTION

This invention relates generally to box structures, as for example are usable for produce packaging, and more particularly to boxes having certain relatively thinner walls fastened, to relatively thicker walls, to provide open box tops which then may be rapidly closed by lids removably attached to the thicker end walls.

Box structures or containers of the above type, as for produce such as grapes (for example), have been utilized employing wooden end walls which are relatively thick, to facilitate nailing of the thinner side and bottom walls to the thicker end walls. However, such boxes must be extremely inexpensive, yet sturdy, whereas the cost of wood has become prohibitive. Efforts have been made, accordingly, to produce and use boxes made of paperboard; however, such boxes tend to collapse when a number of filled boxes are stacked one on top of another. There is need for improvements in construction of such boxes, enabling use of other less expensive materials.

Boxes made at least in part of plastic material are not considered satisfactory, due to excessive weight of plastic walls, and tendency of such walls to develop cracks when nails are driven into the edges of walls, as are required in such boxes. There is need for an improved box construction meeting the above need, and obviating the described problems, as well as other problems encountered in this area.

SUMMARY OF THE INVENTION

It is a major object of the invention to provide an improved box construction meeting the above needs. Basically, the improved structure comprises:

a) box side walls, bottom wall, and two end walls, the two end walls each having substantially greater thickness than the side walls, and the bottom wall, b) the end walls having peripheral edges, the bottom wall and side walls having edge portions overlapping certain of the peripheral edges of the end walls, c) there being means attaching the bottom wall and side wall edge portions to the end wall peripheral edges, d) the end walls consisting essentially of lightweight, cellular synthetic resin, e) the side walls and bottom wall defined by thin, inner and outer sheets and webs interconnecting the sheets, the webs being elongated whereby parallel, elongated cells are formed by the inner and outer sheets and webs, the inner and outer sheets consisting of synthetic resin.

As will be seen, the use of end wall cellular synthetic resin, or plastic, prevents crack growth when nails are driven into the end walls; while at the same time providing a lightweight, low cost, high strength end wall material. Such material may advantageously consist of foamed, low cost, polyethylene molded to have lightweight construction. Such end walls are reusable, as will be seen. Alternatively, the side walls and bottom wall may be adhesively connected to the end walls. Typically, the bottom wall and side walls form a continuous strip which is folded to fit against the certain peripheral edges of the end walls, the certain peripheral edges being flat; and such folded walls may have thickness between about 1/32 and 6/32 inch; and the end wall thickness may be between about 18/32 and 20/32 inch. Folding of the strip is facilitated by web angularity relative to the two sheets to which the webs are connected, the elongated cells between the webs having parallelogram configurations.

Another object is to provide box plastic end walls, as referred to, which define inner sides forming the box interior, and outer sides facing the box exterior, the end walls forming recesses between their inner and outer sides, and in spaced relation to the fasteners. Such end walls may typically and advantageously form, in part, a regular grid pattern about the recesses, and spaced from those edge portions which receive nail penetration. The gridwork recesses typically extend through the end walls between the inner and outer sides, and throughout medial extents of the end walls spaced from all edge portions of the molded plastic end walls, providing an exceptionally strong, yet lightweight construction, which is nailable and prevents crack growth. Corners of the end walls may be beveled, as will be seen.

These and other objects and advantages of the invention, as well as the details of an illustrative embodiment, will be more fully understood from the following specification and drawings, in which:

DRAWING DESCRIPTION

DETAILED DESCRIPTION

In FIGS. 1–4, the produce box structure 10 includes box side walls 11*a* and 11*c*, box bottom wall 11*b* and box end walls 12 and 13, which are alike. Walls 11*a*, 11*b* and 11*c* preferably have the same thickness $t_1$ which is substantially less than the overall thickness $t_2$ of each of the end walls. Thickness $t_2$ is substantially greater than $t_1$, and these may have the following values:

$t_1 \cong 5/32$ inch (between 4/32 & 6/32)

$t_2 \cong 19/32$ inch (between 18/32 & 20/32)

Figure 1:
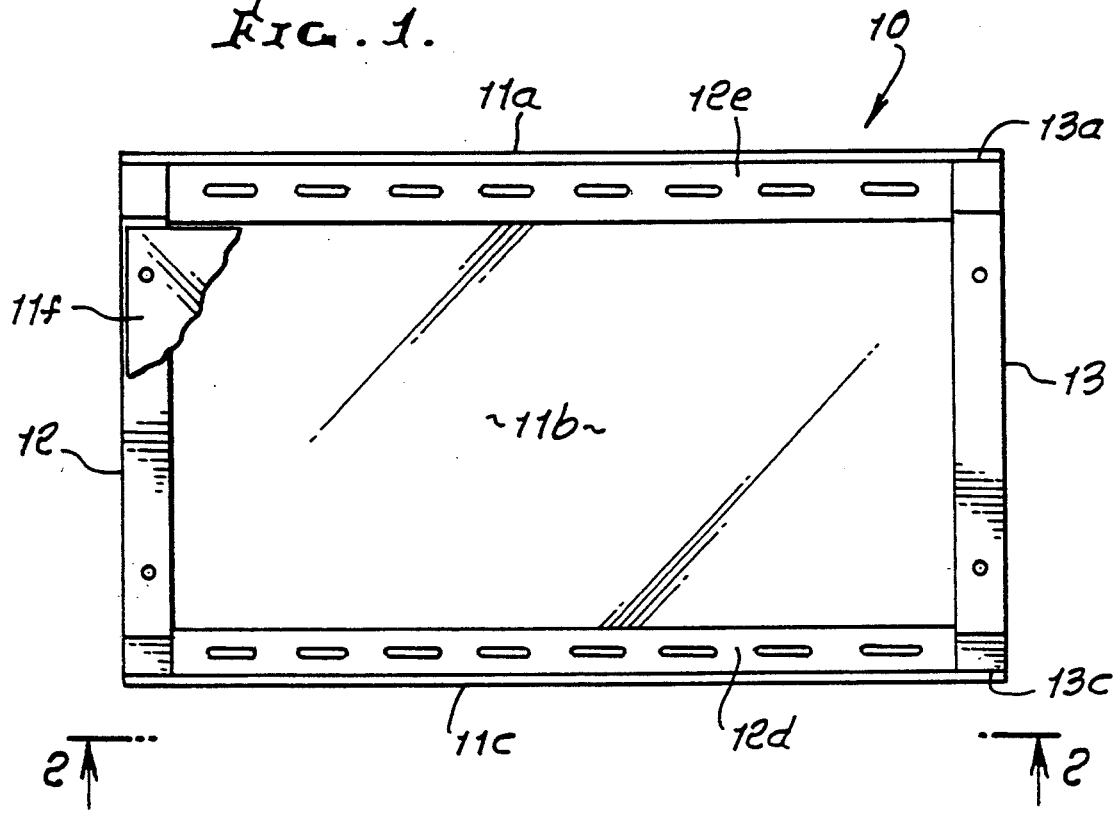
FIG. 1 is a top plan view of a produce box incorporating one form of the invention.
Figure 2:
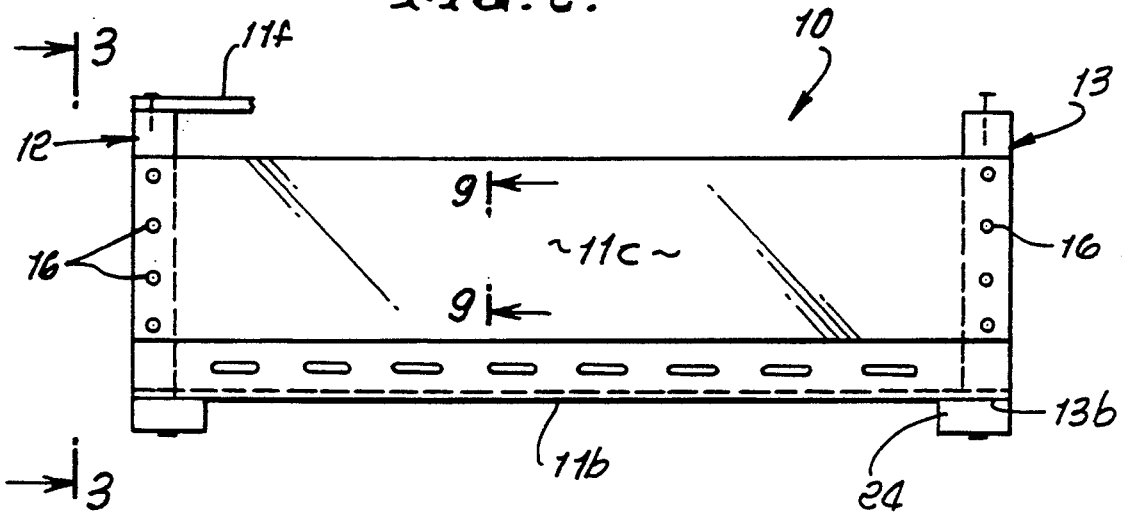
FIG. 2 is an elevation taken on lines 2—2 of FIG. 1.
Figure 3:
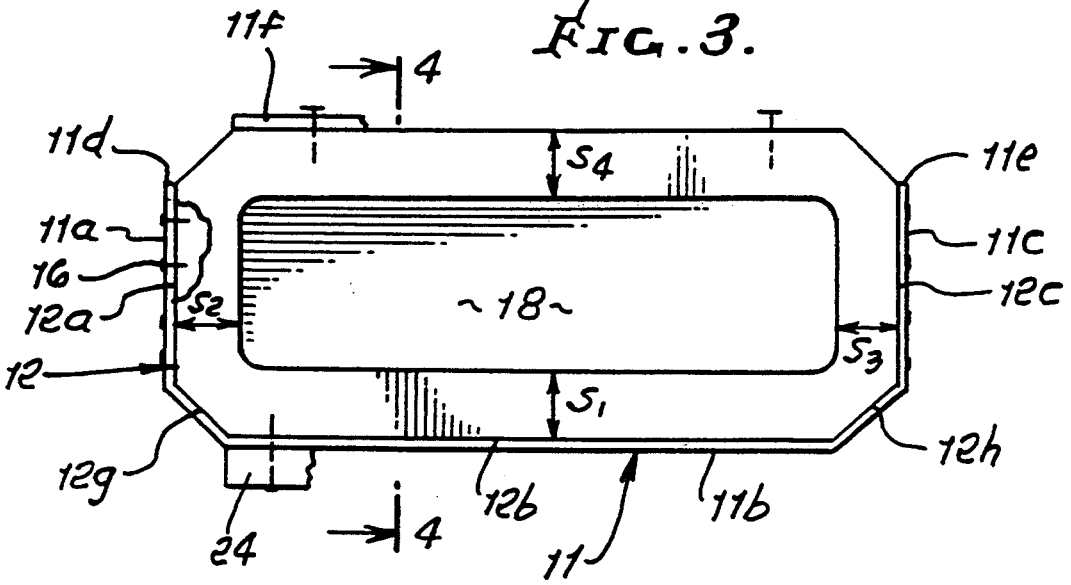
FIG. 3 is an end elevation taken on lines 3—3 of FIG. 2.
Figure 9:
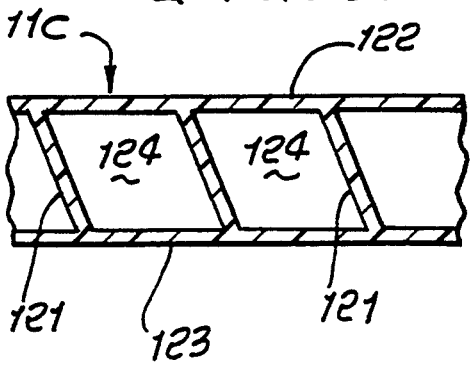
FIG. 9 is an enlarged section taken on lines 9—9 of FIG. 2.
Figure 10:
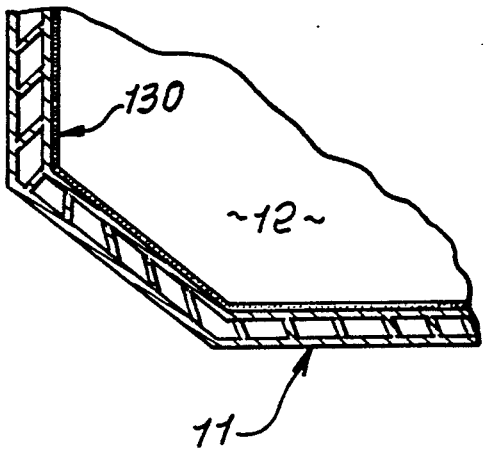
FIG. 10 shows use of adhesive to connect the side and bottom walls to the end walls.

Walls 11*a*, 11*b* and 11*c* preferably form a continuous rectangular strip or sheet 11 folded to have its opposite edge portions overlap and fit flatly against peripheral edges 12*a*, 12*b* and 12*c*, and 13*a*, 13*b* and 13*c* of the end walls. Opposite ends of the strip 11 are indicated at 11*d* and 11*e*. Corners of the end walls 12 and 13 are similarly beveled, as seen at 12*g–h* whereby strip 11 also fits flatly against beveled edges 12*g* and 12*h*, as seen in FIG. 3. Strip 11 consists of plastic material internally reinforced, as by means of very thin, flat webs 121, integral with parallel outer sheets 122 and 123. See FIG. 9. The webs are angled relative to the sheets as seen in FIG. 9, whereby cells 124 formed between the webs have parallelogram configurations, aiding in folding at corners, as seen in FIGS. 3 and 10. Cells 124 extend lengthwise in directions between the end walls.

In accordance with an important aspect of the invention, the end walls 12 and 13 consist of cellular synthetic resin, as for example, and preferably, lightweight, foamed, low cost polyethylene. The specific gravity is between 0.800 and 0.940.

Figure 8:
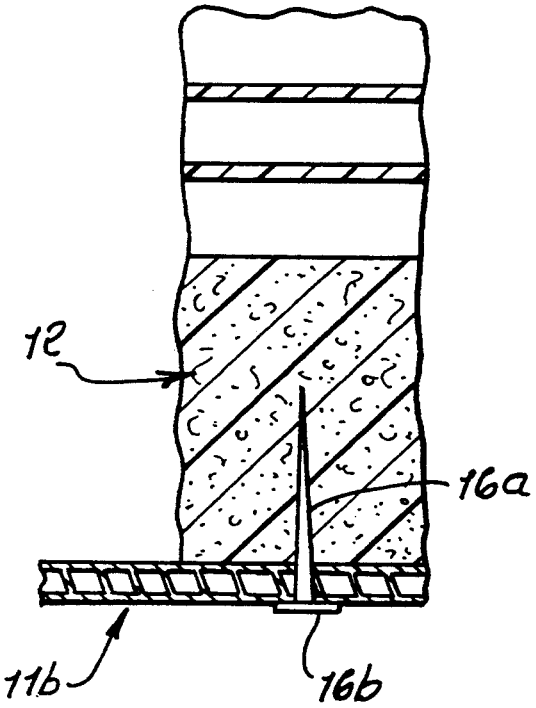
FIG. 8 is an enlarged section showing nailing detail.

Fasteners indicated at 16 may be employed to attach the edge portions of the side and bottom walls 11*a*–11*c* to the end wall peripheral edges 12*a*–12*c* and 13*a*–13*c*, as referred to above. Such fasteners typically comprise nails having shanks 16*a* and heads 16*b*. The nail shanks frictionally penetrate the cellular plastic material (see FIG. 8), and any cracks formed during forcible nailing are interrupted by the cells of the foamed plastic to stop their spreading. Also, the cellular construction of side, bottom and end walls facilitates such nailing, as contrasted with solid plastic which would prevent satisfactory nailing. Alternatively, the side, bottom and top walls may be attached to the end walls as by adhesive as seen at 130 in FIG. 10. One usable adhesive is epoxy.

Figure 4:
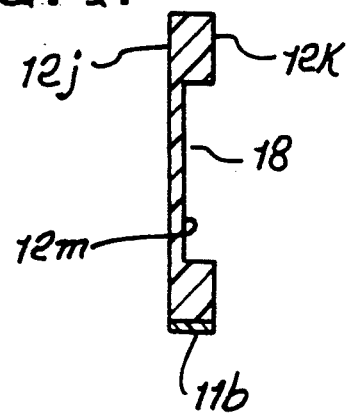
FIG. 4 is a section taken in elevation on lines 4—4 of FIG. 3.

In accordance with another feature of the invention, the plastic end walls are molded to form recesses 18 sunk into the outer sides of the end walls, as seen in FIGS. 3 and 4. Recesses 18 are elongated lengthwise of the end walls, and spaced inwardly of edges of the end walls receiving nails, as referred to. See for example spacings $s_1$–$s_4$ in FIG. 3. Such recesses decrease the weight of the box, and save plastic material. Inner and outer sides of end wall 12 appear at 12*j* and 12*k* in FIG. 4. The inner wall 12*m* of the recess 18 is closer to wall 12*j* than to wall 12*k*.

Figure 6:
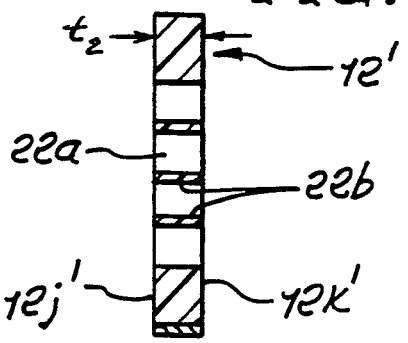
FIG. 6 is a section taken in elevation on lines 6—6 of FIG. 5.
Figure 5:
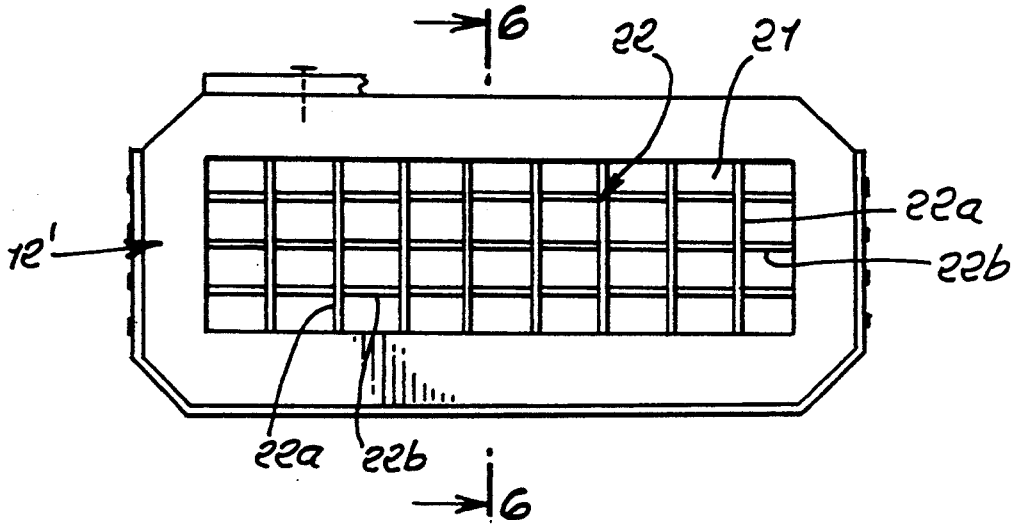
FIG. 5 is an end elevation showing a box incorporating a modified plastic end wall having a grid construction.

FIGS. 5 and 6 show an alternative and preferable form of recessing 21 in the molded plastic end wall 12', which has foamed construction, as referred to above. Such recessing is formed by a plastic grid 22 integral with the end wall 12', with vertically extending, laterally spaced thin webs 22*a*, and horizontally extending, vertically spaced flat webs 22*b*, webs 22*a* intersecting webs 22*b*, as shown. The recesses 21 extend entirely through the end wall between its inner and outer sides 12*j'* and 12*k'*. See FIG. 6. Such recesses substantially lighten the overall weight of the box construction, yet maintain end wall strength support for stacking of a large number of fruit or produce-filled boxes without collapse.

Figure 7:
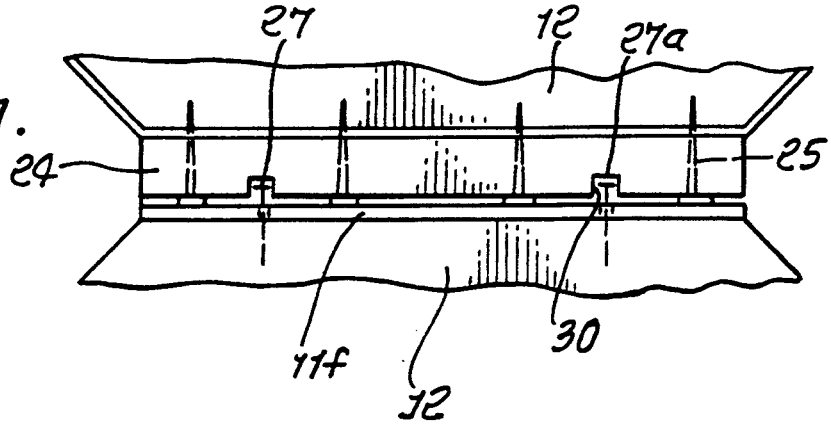
FIG. 7 is a fragmentary elevation illustrating box stacking.

FIG. 7 shows such stacking, with a slat 24 attached by nails 25 to the bottom of a box and extending under its plastic end wall 12, receiving the heads of the nails 27 that are driven downwardly into the upper extent of plastic end wall 12 of the next below box. Heads 27*a* are received in recesses 30 to maintain the upper and lower boxes in alignment.

In this regard, nails 27 serve to loosely retain a box lid or top wall 11*f* to the top of the end wall upper edges, and also protrude upwardly to fit in box stack alignment notches 30 formed in slat 24. Top wall or lid 11*f* may have the same plastic, cellular construction as the side and bottom walls, and as seen in FIG. 9, and may be nailed or adhesively connected to top edges of the end walls.

The plastic material of the walls 11*a*–11*d* may be polypropylene.

I claim:

1. In a box structure, the combination comprising a) box side walls, bottom wall, and two end walls, said two end walls each having substantially greater thickness than said side walls, and said bottom wall, b) the end walls having peripheral edges, said bottom wall and side walls having edge portions overlapping certain of said peripheral edges of the end walls, c) there being attachment means attaching said bottom wall and side wall edge portions to said end wall peripheral edges, d) said end walls consisting essentially of lightweight, cellular synthetic resin, e) said side walls and bottom wall defined by thin, inner and outer sheets and webs interconnecting said sheets, said webs being elongated whereby parallel, lengthwise elongated cells are formed by said inner and outer sheets and webs, said inner and outer sheets consisting of synthetic resin, said cells having length direction, f) said bottom wall and side walls forming a continuous strip which is folded to fit against said certain peripheral edges of said end walls, said certain peripheral edges being flat, g) successive of said webs extending at the same slant angles between said sheets, whereby said elongated cells have parallelogram configuration in planes normal to the length direction of said elongated cells, h) said elongated cells between said webs extending toward said end walls, i) each of said end walls being generally rectangular and having beveled corners.

2. The combination of claim 1 wherein said cellular resin of said end walls consists of foamed polyethylene.

3. The combination of claim 1 wherein said strip has thickness between 4/32 and 6/32 inch and said end walls have overall thickness between 18/32 and 20/32 inches, said webs being everywhere integral with said inner and outer sheets.

4. The combination of claim 1 wherein said attachment means comprises nails extending through said sheets and parallelogram cells and into said end walls.

5. The combination of claim 1 wherein said attachment means consists of adhesive.

6. The combination of claim 1 wherein there is an interior and an exterior of the box structure, said end walls define inner sides forming the box interior, and outer sides facing the box exterior, said end walls forming recesses between said inner and outer sides, and in spaced relation to said side walls and bottom wall.

7. The combination of claim 6 wherein said end walls form a regular grid pattern about said recesses.

8. The combination of claim 7 wherein said recesses extend through the end walls between said inner and outer sides.

9. The combination of claim 1 wherein said box side walls have upper parts thereof angled to overlap said interior.

10. The combination of claim 1 including a box top wall attached to said end walls and having the same cellular construction as said side and bottom walls.

11. The combination of claim 1 including a top cover on the box structure and nails driven through the top cover and into end wall peripheral edges which face upwardly, the nails having heads spaced above said top cover, a support slat overlying said cover, and alignment notches in the slat loosely receiving said nail heads.

12. The combination of claim 11 including another box structure like that of claim 1, and having its bottom wall attached to the slat, at the upper side thereof.

13. In a box structure, the combination comprising a) box side walls, bottom wall, and two end walls, said two end walls each having substantially greater thickness than said side walls, and said bottom wall, b) the end walls having peripheral edges, said bottom wall and side walls having edge portions overlapping certain of said peripheral edges of the end walls, c) there being fasteners attaching said bottom wall and side wall edge portions to said end wall peripheral edges, d) said end walls consisting essentially of lightweight synthetic resin, e) there being an interior and an exterior of the box structure, said end walls defining inner sides forming the box interior, and outer sides facing the box exterior, said end walls forming recesses between said inner and outer sides, and in spaced relation to said fasteners, f) said side walls and bottom wall defined by thin, inner and outer sheets and webs interconnecting said sheets, said webs being elongated whereby parallel and lengthwise elongated cells are formed by said inner and outer sheets and webs, said cells having length direction, said inner and outer sheets consisting of synthetic resin, said webs extending at slant angles between said sheets, whereby said elongated cells have parallelogram cross-sectional configuration in planes normal to the length directions of said elongated cells, g) and wherein said bottom wall and side walls form a continuous strip which is folded to fit against said certain peripheral edges of said end walls, said certain peripheral edges being flat.

14. The combination of claim 13 wherein said end walls form a regular grid pattern about said recesses.

15. The combination of claim 14 wherein said recesses extend through the end walls between said inner and outer sides.

16. The combination of claim 13 wherein said resin of said end walls consists of foamed polyethylene.

* * * * *